US011120957B2

(12) United States Patent
Lell

(10) Patent No.: US 11,120,957 B2
(45) **Date of Patent: *Sep. 14, 2021**

(54) ELECTRICAL INTERRUPTION SWITCHING ELEMENT WITH A TUBULAR SEPARATING ELEMENT WITH VARYING WALL THICKNESS

(71) Applicant: Peter Lell, Moosburg (DE)

(72) Inventor: Peter Lell, Moosburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/795,765

(22) Filed: Feb. 20, 2020

(65) Prior Publication Data

US 2021/0050166 A1 Feb. 18, 2021

(51) Int. Cl.
*H01H 33/53* (2006.01)
*H01H 33/76* (2006.01)

(52) U.S. Cl.
CPC ..... *H01H 33/76* (2013.01); *H01H 33/53* (2013.01)

(58) Field of Classification Search
CPC ..... H01H 33/76; H01H 33/53; H01H 33/94; H01H 33/70; H01H 33/84; H01H 39/00; H01H 39/006; H01H 39/002; H01H 85/00; H01H 85/11; H01H 85/40
USPC ..... 218/56, 95, 155, 158; 200/61, 61.08; 337/30, 157
See application file for complete search history.

(56) References Cited

U.S. PATENT DOCUMENTS 2,892,062 A 6/1959 Bruckner et al.
3,848,100 A * 11/1974 Kozorezov ..... H01H 39/006 200/61.08
4,345,127 A * 8/1982 Niemeyer ..... H01H 39/006 200/61.08
6,994,030 B2 * 2/2006 Perut ..... B01L 3/50273 102/202.5
8,534,174 B2 * 9/2013 Kajita ..... F42B 3/006 83/399

(Continued)

FOREIGN PATENT DOCUMENTS

DE 1046163 A 12/1958
DE 19819662 * 11/1998 ..... H01H 39/00

(Continued)

OTHER PUBLICATIONS

Translation of DE 19819662 (Original document published Nov. 12, 1998) (Year: 1998).*

*Primary Examiner* — William A Bolton
(74) *Attorney, Agent, or Firm* — Perry + Currier, Inc.

(57) ABSTRACT

An example electrical interruption switch includes a casing, surrounding a contact unit defining current path therethrough. The contact unit has a first and second connection contact and a separation region. A current supplied to the contact unit via the first connection contact can be discharged therefrom via the second connection contact, or vice versa. The separation region includes a tubular element, an axial direction of which runs along an axis X, wherein the tubular element is separable into two parts along a plane perpendicular to the axis X, whereby the current is interrupted between the first and the second connection contact, wherein the tubular element has two opposite end regions along the direction of extent of the axis X, characterized in that the tubular element has a minimum wall thickness, which increases in each case in the direction of the end regions, in a region between the end regions.

10 Claims, 4 Drawing Sheets

(56) References Cited

U.S. PATENT DOCUMENTS

Figure 1:
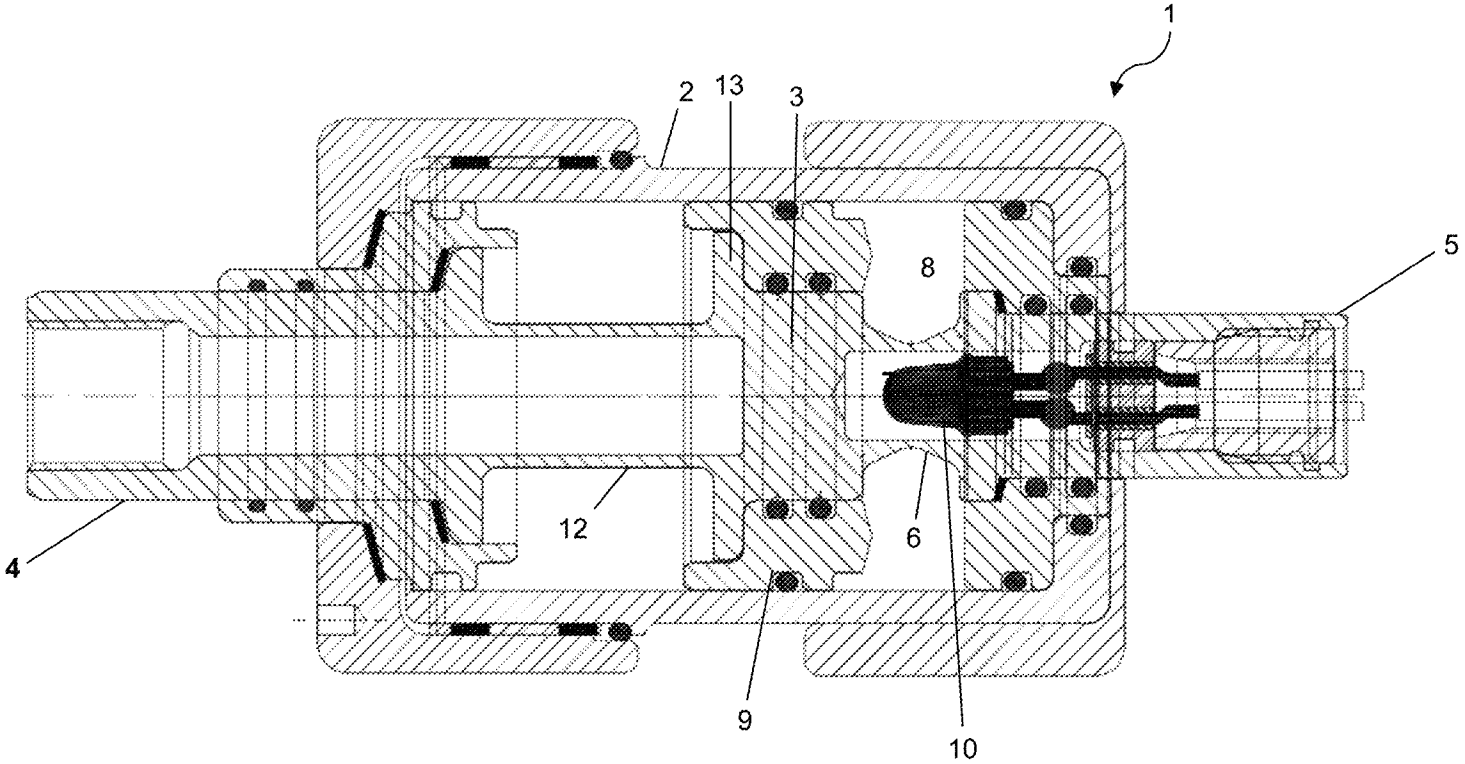

| | | | | |
|---|---|---|---|---|
| 8,957,335 | B2 * | 2/2015 | Sprenger | B23D 15/145 200/61.04 |
| 9,911,560 | B2 * | 3/2018 | Lell | H01H 39/006 |
| 2013/0175144 | A1 | 7/2013 | Sprenger et al. | |

FOREIGN PATENT DOCUMENTS

| | | | |
|---|---|---|---|
| DE | 102010035684 | A1 | 3/2012 |
| DE | 202017106260 | U1 | 11/2017 |
| DE | 202017106261 | U1 | 11/2017 |
| DE | 102017123021 | A1 | 12/2017 |
| DE | 102018103018 | A1 | 3/2018 |
| WO | WO-2019068284 | A1 | 4/2019 |
| WO | WO-2019154463 | A1 | 8/2019 |

* cited by examiner

ELECTRICAL INTERRUPTION SWITCHING ELEMENT WITH A TUBULAR SEPARATING ELEMENT WITH VARYING WALL THICKNESS

The invention relates to an electrical interruption switch, in particular for interrupting high currents at high voltages.

Such interruption switches are used for example in power plant and motor vehicle technology, and also in general mechanical and electrical engineering in electric switchboards of machines and plants, as well as within the framework of electromobility in electric and hybrid vehicles, but also in electrically operated helicopters and aircraft, for the defined and fast disconnection of high-current electrical circuits in case of an emergency. It is required of such switches that no hot gas, particles, ejected fragments or plasma leak from them. Furthermore, such switches are to ensure insulation resistance after the disconnection.

Further areas of application are the electrical disconnection of an assembly from the on-board electrical system in the event of a short circuit in the assembly concerned, for example in an independent electric heating system or in an electric brake, as well as the emergency shutoff of a lithium battery, such as are used today in electric and hybrid vehicles, as well as in aircraft. These batteries, with a small overall installed size, have a high terminal voltage of up to 1200 V with extremely low internal resistance. Both of these can potentially result in a short-circuit current of up to 5000 A, in some cases and briefly even up to 30 kA, without the source voltage dropping significantly, which even after a few seconds can lead to the battery igniting or exploding. The interruption switch presented here is also highly suitable for the emergency shutoff of individual solar cell modules or entire solar cell arrays should it be necessary, because it can be designed triggerable or remote-controllable.

All use cases mentioned here as a rule involve shutting off direct current, which, unlike alternating current, has no zero crossing. Normally, there is only the operating voltage in an interruption switch. At the moment of disconnection of a direct current circuit in an interruption switch, however, due to the collapse of the magnetic field of the outer electric circuit, the voltage increases strongly such that as a rule an electric arc forms between the separated ends of a separation element of an interruption switch. As a rule, a relatively high voltage is needed to generate an electric arc. However, to maintain it, much lower voltages are already sufficient, which is the case as a rule with usual operating voltages of approximately 450 V.

In order that the electric arc is also extinguished after the voltage peak has fallen to the operating voltage, switches with a contact tube with a separation region in the form of a hollow cylinder are already used, wherein the hollow cylinder is completely torn open, melted open or broken open to disconnect the electric circuit along its cross-sectional surface area, and the two ends of the hollow cylinder are mechanically moved away from each other. To tear open or break open the hollow cylinder, an activatable drive is often used which is located in the cavity of the hollow cylinder. However, it has been established that through the ignition of the activatable drive or through the formation of the electric arc and the pressure build-up associated therewith due to vaporization of the surrounding extinguishing medium, relatively large parts of the separation region are often torn away, which can then trigger a short circuit in other parts of the interruption switch due to undesired bridging of two live regions.

Starting from this state of the art the object of the invention is to provide an interruption switch, in particular for interrupting high direct currents at high voltages, in which as far as possible no or only a few, and then only small, conductive fragments, which can cause a short circuit, are released internally during the transition from the conducting position into the separating position.

The invention achieves this object with the features provided herein.

The interruption switch according to the invention can be transferred from a conducting position into a separating position. If the interruption switch according to the invention is integrated into an electric circuit, the electric circuit is closed in the conducting position. The electric circuit is interrupted in the separating position. The interruption switch according to the invention has a casing, which surrounds a contact unit defining the current path through the interruption switch, i.e. the contact unit is surrounded by the casing. The contact unit has a first and a second connection contact and a separation region. The contact unit is formed such that a current can be supplied to it via the first connection contact and can be discharged therefrom via the second connection contact, or vice versa. The separation region is designed as a tubular element, the axial direction of extent of which runs along an axis X, wherein the tubular element can be separated into two parts along a plane perpendicular to the axis X, whereby the current is interrupted between the first and the second connection contact. The tubular element has two opposite end regions along the direction of extent of the axis X.

The interruption switch according to the invention is characterized in that the tubular element has a minimum wall thickness, which increases in each case in the direction of the end regions, in a region between the end regions, wherein preferably excluded therefrom are those regions of the tubular element in which the cross sections increase radially towards the end regions (called "radially running cross-section transitions" in the following). In other words, the tubular element has a region with a taper of the wall thickness between the end regions, in particular not only between the end regions, but also in a region between the radially running cross-section transitions. The tubular element thus preferably has a minimum wall thickness, which increases in each case in the direction of the cross-section transitions, in a region between the radially running cross-section transitions bordering the respective end regions.

Through the increase in the wall thickness, unlike in the case of an unchanging wall thickness, parts of the separation region can be largely prevented from tearing away during the transition from the conducting position into the separating position, with the result that there are no larger electrically conductive parts available for the electrical bridging of undesired regions inside the interruption switch. The risk of an internal short circuit occurring in the interruption switch according to the invention can be minimized or even entirely prevented in this way.

Hereby, no larger parts are torn out of the tube-like connecting element, but the material is effectively beaded or rolled up at the separation point in the direction of a thicker wall thickness or in the direction of the end regions; it therefore also remains after the separation at the tubular end pieces.

The tubular element preferably has a cross-sectional surface area closed like a ring, which is preferably perpendicular to the axial direction of extent (axis X). The cross-sectional surface area can have any desired shape, for example annular, elliptical, annular as desired without or with one or more corners, triangular, quadrangular, pentagonal, hexagonal or polygonal, wherein an annular cross-sectional surface area is preferred.

The increase in the wall thickness can be continuous or discontinuous, i.e. for example stepped, in the axial extent of the tubular element, wherein a continuous increase is preferred. The continuous increase can be effected linearly or progressively. It is preferred according to the invention that the wall thickness increases in each case conically in the direction of the end regions of the tubular element. Furthermore, it is preferred for the tubular element to be designed such that it has a cross-sectional surface area of identical shape in every plane perpendicular to the axis X. Furthermore, the increase in the wall thickness can run differently or identically, i.e. mirror-symmetrically, in both directions towards the end regions of the tubular element, wherein the mirror plane is arranged in the region of the minimum wall thickness perpendicular to the axis X. The mirror-symmetrical increase in both directions is preferred according to the invention, as the effect of preventing torn-off parts is then particularly great. It is also preferred for the cross-section transitions to run radially towards the respective end regions of the tubular element, i.e. to be provided with particular radii, in order to prevent notch stresses that are too high here, which could partially break or break open the tubular element in an undesired manner at these points, in particular in the case of mechanical stresses or vibrations of the assembly or of the connecting element.

The region of the minimum wall thickness of the tubular element can be formed as a region with unchanging wall thickness. It is preferred for the cross-section transitions to run radially from the region with minimum wall thickness towards the regions in which the wall thickness increases, i.e. to be provided with particular radii. In an embodiment, such a region with unchanging wall thickness can also be dispensed with, i.e. in the region of the minimum wall thickness the regions in which the wall thickness increases converge, likewise preferably with a radially running cross-section transition.

The two opposite end regions of the tubular element preferably in each case merge into flanges which extend in the direction of the casing and perpendicular to the axis X.

In a design, the interruption switch according to the invention has at least one chamber, which is at least partially delimited by the separation region. The at least one chamber is preferably filled with an extinguishing agent, with the result that the separation region is in contact with the extinguishing agent. The at least one chamber is preferably located inside the cavity of the tubular element of the separation region, i.e. is surrounded by the separation region. Furthermore, the interruption switch according to the invention can have a further chamber, which borders the outer region of the tubular element of the separation region. In other words, the tubular element delimits the at least one chamber from the further chamber. The further chamber is preferably delimited in its outer circumference by the casing of the interruption switch. The further chamber is preferably likewise filled with an extinguishing agent.

However, filling the cavity of the tubular element can also be dispensed with, in this case only the further chamber outside the tubular connecting element is filled with an extinguishing agent. In the case of very small currents to be disconnected in conjunction with very small electric circuit inductances, however, the extinguishing agent can also be dispensed with entirely, here the enclosed air is then sufficient for the disconnection operation.

The extinguishing agent can be a solid, powdery or liquid medium. The extinguishing agent is preferably a vaporizable or gasifiable medium (e.g. boric acid; this powder passes directly from the powdery phase into gas when affected by an electric arc, wherein it absorbs energy and thus depletes the electric arc). The extinguishing agent is preferably a liquid medium, which passes entirely or partially into a gaseous state when the boiling or vaporization temperature is reached. At the same time, it is preferred for the extinguishing agent to also have good electrically insulating properties, in order that the electric arc can be extinguished after the two separated parts of the separation region have been moved away from each other sufficiently and there is thereafter a sufficient insulation from a current flow, which is then undesired here, between the separated contacts. The extinguishing agent is preferably an oil with or without thickening agent, for example silicone oil, or a silane or polysiloxane, for example hexasilane or pentasilane with as little as possible, or even better without, carbon atom content.

In a design, the interruption switch according to the invention has a sabot, which can be moved from a starting position into an end position, wherein in the end position of the sabot an insulation spacing between the first and the second connection contact is achieved. The sabot has the object of separating the two separated parts of the separation region from each other by carrying out, through exposure to pressure, a mechanical movement which moves one part of the separated separation region away from the other part of the separated separation region. In this way, a safe distance between the two separated parts of the separation region is produced.

The tripping of the interruption switch according to the invention, i.e. of the operation of transition from the conducting position into the separating position, can be effected passively or actively.

If the tripping of the interruption switch according to the invention is to be effected actively, it is preferred for the interruption switch to comprise an activatable material. The activatable material is preferably arranged such that, when the pyrotechnic material is ignited, the separation region is exposed to a gas pressure or shock wave generated by the activatable material, with the result that the separation region is torn open, caved in or separated. The sabot is preferably designed such that, when the activatable material is ignited, it is exposed to a gas pressure or shock wave generated thereby such that the sabot in the casing is moved in a movement direction from the starting position into the end position and in the process the separation region is torn open, caved in or separated.

The activatable material can be a pyrotechnic material, which acts in a detonative or deflagrating manner. The pyrotechnic material is present in the interruption switch according to the invention, preferably in a so-called mini detonator, or an ignition tablet or squib, but can also be introduced in another form.

If the tripping of the interruption switch according to the invention is to be effected passively, i.e. without an activatable material to sever the separation region for the first time, it is preferred for the separation region, the sabot and the extinguishing agent to be formed such that the separation region can be separated into at least two parts through the supplied current when a threshold amperage is exceeded by heating to or beyond the melting point of the material of the connecting element, wherein an electric arc forming between the two parts of the separation region vaporizes the extinguishing agent, with the result that a gas pressure to which the sabot is exposed forms, wherein the sabot in the casing is again moved in a movement direction from the starting position into the end position.

Furthermore, the separation region can also have one or more predetermined breaking points, which can be present in the form of a narrowing, notch, groove or hole. The predetermined breaking point is preferably present in the form of a hole through the wall of the tubular element of the separation region. In this way, the hole connects the at least one chamber to the further chamber. In this way, during the production of the interruption switch according to the invention it is easier to pour an extinguishing agent into the at least one chamber inside the tubular element.

According to a design of the invention, the contact unit can have an upsetting region. The upsetting region can be designed such that it surrounds a yet further chamber. The upsetting region can be designed such that it is upset during the separation operation of the separation region. It is preferred for the material of the upsetting region to be an easily deformable, optionally also soft-annealed material, in order to improve the folding behavior of the upsetting region. The upsetting region can be designed with regard to the material and the geometry such that the wall of the upsetting region is folded, preferably folded in a meandering fashion, as a result of the upsetting movement.

In a design of the invention, the upsetting region can be formed such that it is upset during the movement of the sabot from the starting position into the end position, wherein the upsetting region is preferably designed as a tubular or rod-shaped element, the axial direction of extent of which runs along an axis X, wherein the tubular or rod-shaped element can have one or more tapers in its cross-sectional diameter, wherein the cross-sectional diameter is defined perpendicular to the axis X. The upsetting region can thus be present as a tubular element, like the separation region of the connecting element. All preferred embodiments with regard to the tubular element of the separation region also apply to the tubular element of the upsetting region. However, the upsetting region can also be formed as a rod-shaped element, the outer surface of which can in principle run in the same way as when it is formed as a tubular element. In other words, the rod-shaped element can have one or more tapers relative to its cross-sectional diameter. Through a linear or stepped change in the wall thickness or in the diameter in the direction of the X-axis of the upsetting region the material can be prevented from tearing open too violently with a corresponding splintering action. In this way, the formation of splinter parts can be prevented. Through the one or more tapers, unlike in the case of a cross-sectional surface area that is unchanging along the axis X, splinters of the upsetting region can be largely prevented from tearing away during the transition from the conducting position into the separating position, with the result that the already separated contact of the interruption switch cannot be contacted electrically towards the casing, with the result that a short circuit cannot form inside the switch.

This is of advantage or great importance in particular in the case of the use of materials for the connecting element which are not as ductile as the electrolytic copper usually used here. For example, for the processing of aluminum as raw material for the connecting element a hard aluminum must be used, which would immediately break up into many small splinters during the folding operation, even after soft-annealing of the connecting element after the production thereof.

The shown changes in the cross-sectional surface areas in the upsetting region are therefore chosen in order to allow the length L of the upsetting region to become longer or to be able to use it before the upsetting region would not upset, but would buckle, due to the pressure load, which would be entirely undesired here:

Corresponding to Euler buckling case 4 (both ends of the buckling rod clamped tightly and pressure load on the rod), the critical buckling load here is calculated as $F_{crit}=4*pi^2/L^2*E*I$ with the clamped length L, the modulus of elasticity of the rod material E and the axial moment of inertia I of the rod cross section. If the critical buckling load is reached, the rod here would buckle in the middle, in the case of hollow bodies would bulge—which is entirely undesired here and is to be safely prevented, because a contact of the disconnecting switch against the casing would thus short-circuit and bypass an insulator.

On the other hand, as long as possible an upsetting length L is desired in order to be able to convert as much as possible of the energy introduced into the assembly/disconnecting switch plastically.

Through the shown changes in the cross-sectional surface areas in the upsetting region, effectively the available upsetting length L is divided into several smaller upsetting stretches, the upsetting regions of which are then predefined by the cross-sectional changes.

The above-described operations apply analogously to all upsetting bodies, regardless of whether their cross section is completely filled (here only kinking occurs) or whether a tube-like upsetting element is present (here kinking and bulging can occur).

According to a design of the invention, the yet further chamber of the upsetting region can also be completely filled with an extinguishing agent. It is preferred for a connection in the form of a channel to be present between the yet further chamber and the at least one chamber. Through the movement of the sabot and/or the upsetting operation of the upsetting region, the volume of the yet further chamber is reduced such that the extinguishing agent is injected through the channel between the at least two parts of the separation region. The extinguishing agent can thereby be pushed out of the yet further chamber via the channel into the at least one chamber during the upsetting operation and thus more effectively suppresses or cools the electric arc possibly still present at the separation region. At the same time the extinguishing agent, which may have already partially decomposed in the at least one chamber, is diluted by the extinguishing agent newly flowing in, and thus the insulating properties of the "stressed" extinguishing agent are likewise improved. In this design of the invention it may also be preferred for only the one chamber and the yet further chamber as well as the connecting channel to be filled with an extinguishing agent. It may be preferred here for the further chamber to contain no extinguishing agent.

The features of the interruption switch according to the invention set out in the above-named embodiments can unless they are mutually exclusive be combined as desired according to the invention.

The invention is explained in more detail below with reference to the embodiments represented in the drawings. All individual features described in the figures can—provided this is technically possible—also be used independently of each other in an interruption switch according to the invention.

FIG. 1 shows a schematic view of an interruption switch according to the invention before the separation region is separated (conducting position), which is present in the form of a tubular element with varying wall thickness.

Figure 2A:
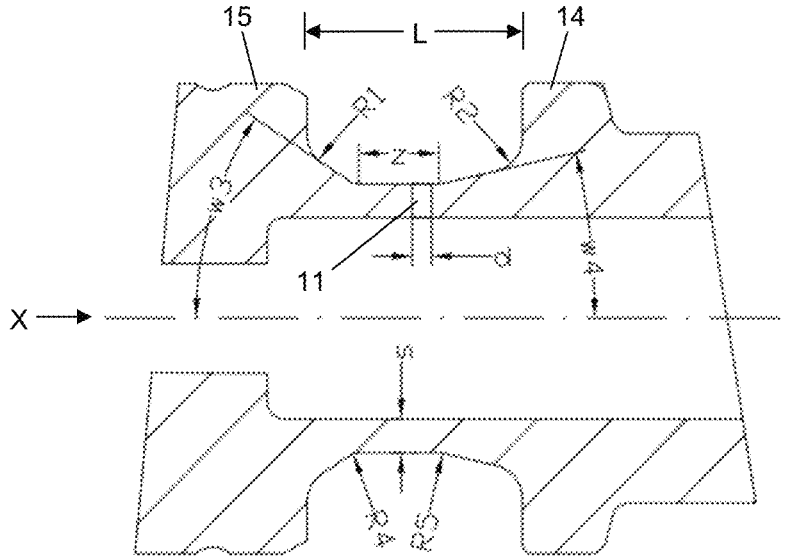
Figure 2B:
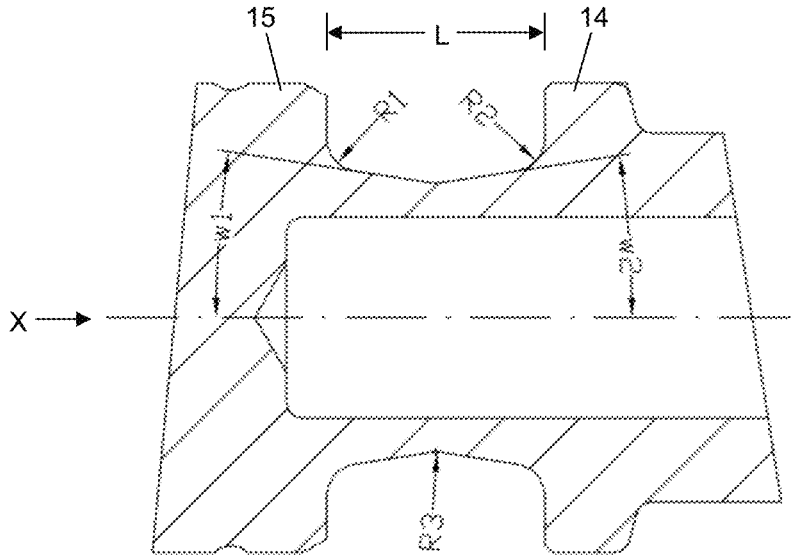

FIGS. 2*a* and 2*b* show sections of a contact unit of an interruption switch according to the invention in the region of the separation regions.

Figure 3A:
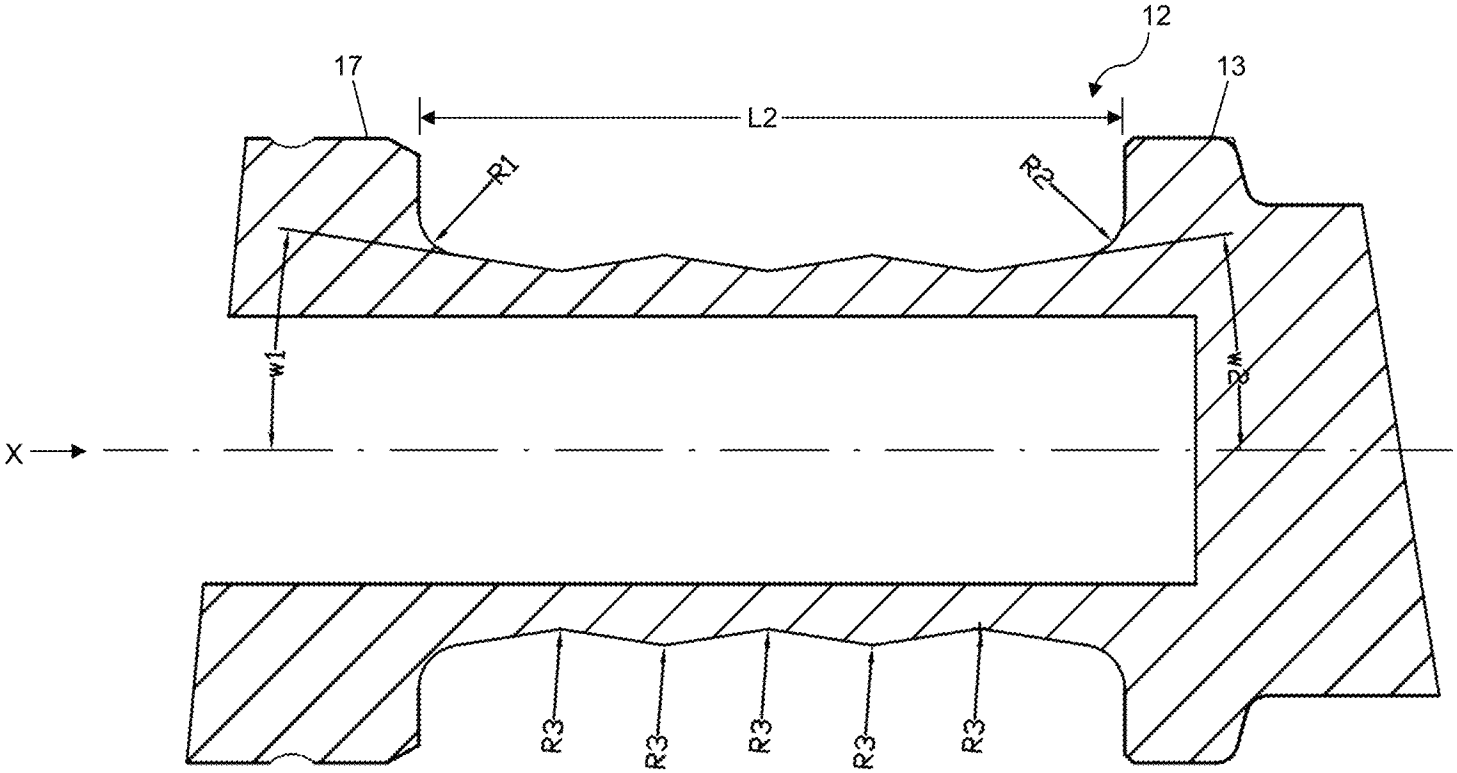
Figure 3B:
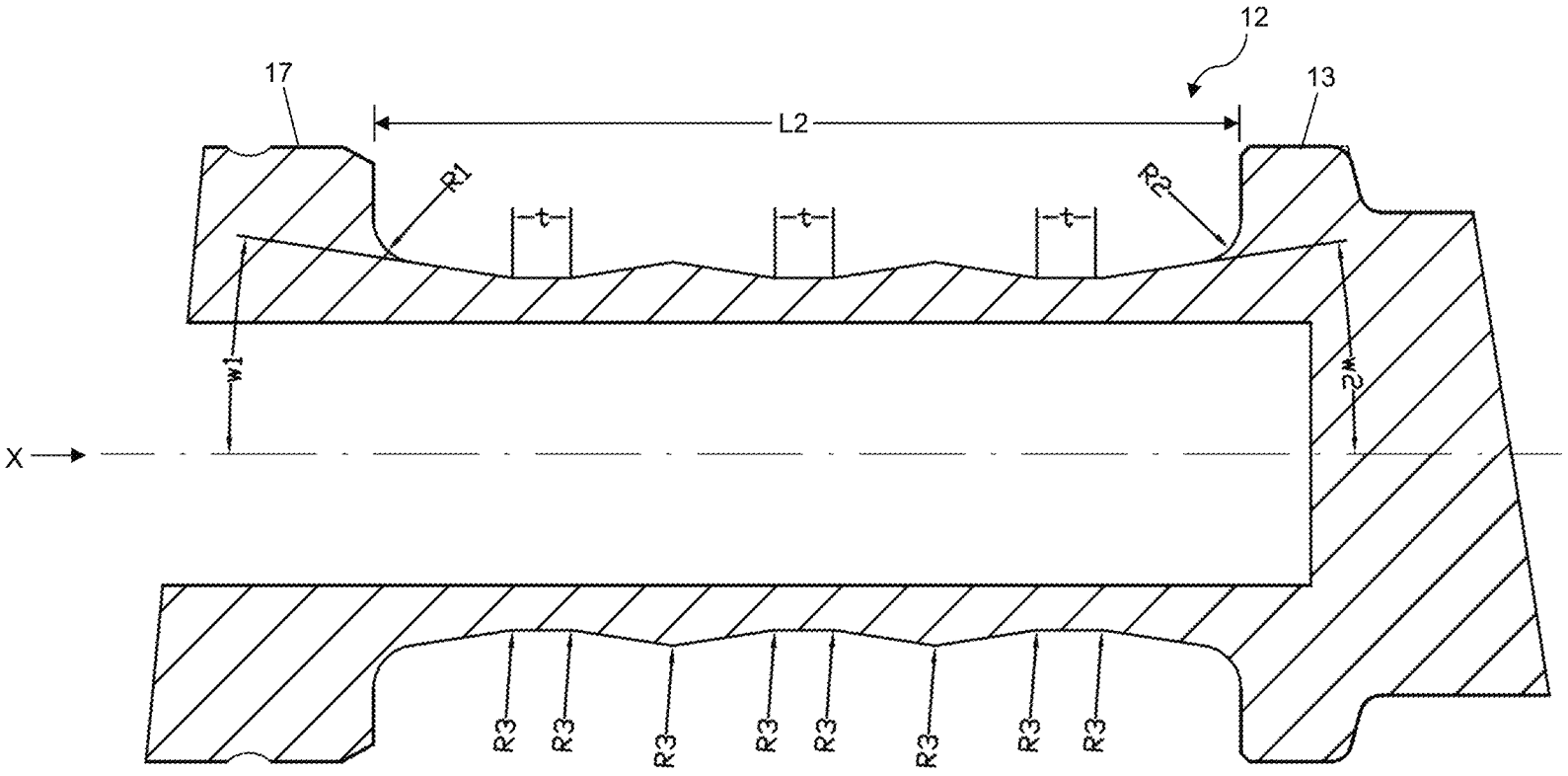

FIGS. 3*a* and 3*b* show sections of a contact unit of an interruption switch according to the invention in the region of the upsetting regions.

The embodiment represented in FIG. 1 of an interruption switch 1 according to the invention comprises a casing 2, in which a contact unit 3 is arranged. The casing 2 is formed such that it withstands a pressure, generated inside the casing 2, which is generated for example in the case of a pyrotechnic tripping of the interruption switch 1, without there being the danger of damage or even bursting. The casing 2 can consist in particular of a suitable material, preferably steel. In the embodiment example represented, the contact unit 3 is formed as a switch tube that can be depressed by the sabot 9 in the upsetting region 12, with the result that it is formed as a tube in the separation 6 and upsetting 12 regions. In the embodiment example represented, the contact unit 3 has a first connection contact 4. Adjoining the first connection contact 4 is a flange extending radially outwards, which is braced on an annular insulator element, which consists of an insulating material, for example a plastic, such that the contact unit 3 cannot be moved out of the casing 2 in the axial direction. The contact unit 3 has an upsetting region 12 adjoining the flange in the axis of the contact unit 3. In the upsetting region 12, which has a predetermined axial extent, the wall thickness of the contact unit is chosen and matched to the material such that, when the interruption switch 1 is tripped as a result of a plastic deformation of the contact unit 3 in the upsetting region 12, the upsetting region 12 is shortened in the axial direction by a predetermined distance.

Adjoining the upsetting region 12 in the axial direction of the contact unit 3 is a flange 13, on which a sabot 9 sits in the embodiment example represented. The sabot 9 is formed as an electrically insulating element, for example a suitable plastic, preferably made of ceramic. This surrounds the contact unit 3 such that an insulating region of the sabot 9 engages between the outer circumference of the flange 13 and the inner wall of the casing 2. If a pressure acts on the surface of the sabot 9, a force is generated which compresses the upsetting region 12 of the contact unit 3 via the flange 13. This force is chosen such that, during the tripping operation of the interruption switch 1, an upsetting of the upsetting region 12 occurs, wherein the sabot 9 is moved from its starting position (status before the interruption switch 1 is tripped=conducting position) into an end position (after the switching operation has been completed=separating position).

As can be seen from FIG. 1, the sabot 9 can be chosen such that its external diameter substantially corresponds to the internal diameter of the casing 2, with the result that an axial guidance of the flange 13 and thus also an axially guided upsetting movement during the switching operation is achieved.

After the pressing operation the lugs of the insulator element and of the sabot 9 located close to the casing 2 overlap completely, with the result that the upsetting region 12 pushed together in a meandering fashion after the tripping and the upsetting operation is completely surrounded by electrically insulating materials.

Adjoining the sabot 9 or the flange 13 of the contact unit 3 is a separation region 6. The second connection contact 5 then adjoins this side of the contact unit 3.

In the embodiment example represented, the sabot 9 is pushed onto the contact unit 3 from the side of the connection contact 5 during the assembly of the interruption switch 1. For this purpose it is split (not drawn). If the second connection contact 5 is not split or if it is in one piece like the contact unit 3, as drawn, the sabot 9 must either be injection-molded or be designed in several parts, in order to be able to install it.

In the axial end of the contact unit 3 in the region of the second connection contact 5 an activatable material 10 can be provided, here often also housed in a mini detonator or a priming screw (drive). Electrical connection lines for the drive can be guided outwards through an opening in the interior of the contact unit 3. The drive is preferably provided in a chamber 7 inside the tubular element of the separation region 6. A further chamber 8 is located between the outer wall of a separation region 6 and the casing 2.

The separation region 6 is dimensioned such that it tears open at least partially, but preferably tears open completely, through the gas pressure generated or the shock wave generated by a drive, with the result that the pressure or the shock wave can also propagate out of the chamber 7 into the outer chamber 8 preferably designed as a surrounding annular space. In this way the chambers 7 and 8 are connected to each other to form one volume. The internal pressure required for upsetting the contact unit 3 can also be generated such that in the case of a particular threshold amperage the separation region 6 melts open and an electric arc forms in between, which vaporizes an extinguishing agent located in the chambers 7 and/or 8. To facilitate the tearing open, the wall of the contact unit 3 in the separation region 6 can also have one or more openings or holes and/or grooves (not shown in FIG. 1). It is to be ensured here that the material of the separation region 6 disconnects the operating current well, thus does not become too hot taking into account heat dissipation, in order that the material cannot be aged too quickly or too much.

When the interruption switch 1 is activated, a pressure or even a shock wave is thus generated on the side of the sabot 9 facing away from the upsetting region 12, whereby the sabot 9 is exposed to a corresponding axial force. This force is chosen through a suitable dimensioning of the activatable material 10 such that in the upsetting region 12 the contact unit 3 is plastically deformed or caved in, but not torn open, and the sabot 9 is then moved in the direction of the first connection contact 4. The activatable material 10 is dimensioned such that, after the separation region 6 has been broken open or caved in, the movement of the sabot 9 moves the two separation halves sufficiently far away from each other, in cooperation with the vaporization of an extinguishing agent then even into an end position.

Directly after the activatable material 10 has been activated, the separation region 6 is thus at least partially torn open or caved in, preferably completely torn open. If the tearing open or caving in has not already been effected before the start of the axial movement of the sabot 9 over the entire circumference of the separation region 6, a residual remainder of the separation region 6, which causes another electrical contact, is completely torn open by the axial movement of the sabot 9, intensified by the very rapid heating then occurring here of the residual cross section of the conductor, which is then only small here, due to the high electric current flowing here.

The interruption switch 1 according to FIG. 1 is in principle constructed exactly like the interruption switch of DE 10 2017 123 021 A1 shown in FIG. 1, with the difference according to the invention that the separation region 6 does not represent a tubular element with a continuously identical wall thickness, but the tubular element has a minimum wall thickness, which increases in each case in the direction of the flange-side end regions, in a region between the flange-side end regions. In FIG. 1 the wall thickness increases substantially linearly, and both regions in which the wall thickness increases are formed mirror-symmetrical to each other, as is for example also shown in FIG. 2*b*.

FIGS. 2*a* and 2*b* show the partial region of a contact unit 3, in which the separation region and the flanges 14 and 15 adjoining it are present. The length L is the extent of the separation region in the direction of the axis X. The separation region has a region with minimum wall thickness, which increases in each case in the direction of the flange-side end regions, i.e. towards the flanges 14 and 15. The radii R1 and R2 represent the radii of the cross-section transitions between the separation region and the adjoining flanges 14 and 15. The radius R3 in FIG. 2*b* represents the radius of the cross-section transition in the region of the minimum wall thickness to the regions of the increasing wall thicknesses. The same applies to the radii R4 and R5 in FIG. 2*a*. As shown in FIG. 2*a*, the region of the minimum wall thickness can also be cylindrical in a length z and only then merge into the regions of the increase in the wall thickness. FIG. 2*b*, by contrast, shows an embodiment in which such a cylindrical region is not present. The thickness s in FIG. 2*a* indicates the minimum wall thickness in the cylindrical region. As shown in FIG. 2*a*, the angles w3 and w4 can be different, i.e. the increase in the wall thickness in the direction of the two flange-side ends of the separation region need not be identical on both sides. The increase in the wall thickness can also be effected uniformly in the direction of both flange-side ends of the separation region, as shown in FIG. 2*b*. The angles w1 and w2 here are therefore equally large. FIG. 2*a* shows a hole as predetermined breaking point 11 in the separation region with the diameter d.

FIGS. 3*a* and 3*b* show the partial region of a contact unit 3, in which the upsetting region 12 and the flanges 13 and 17 adjoining it are present. The length L2 is the extent of the upsetting region in the direction of the axis X. The upsetting region has a region with minimum wall thickness, which increases in each case in the direction of the flange-side end regions, i.e. towards the flanges 13 and 17. The radii R1 and R2 represent the radii of the cross-section transitions between the upsetting region and the adjoining flanges. The radii R3 in FIG. 3 represent the radii of the cross-section transitions in the region of the minimum wall thickness to the regions of the increasing wall thicknesses. As shown in FIG. 3*b*, the region of the minimum wall thickness can also be cylindrical in a length t and only then merge into the regions of the increase or decrease in the wall thickness. FIG. 3*a*, by contrast, shows an embodiment in which such a cylindrical region is not present. The thickness s again indicates the minimum wall thickness in the cylindrical region. As shown in FIG. 3, the angles w3 and w4 can again be different (not drawn here), i.e. the increase in the wall thickness in the direction of the two flange-side ends of the upsetting region need not be identical on both sides. The increase in the wall thickness can also be effected uniformly in the direction of both flange-side ends of the upsetting region, as shown in FIG. 3. The angles w1 and w2 here are therefore equally large.

LIST OF REFERENCE NUMBERS

1 interruption switch
2 casing
3 contact unit
4 first connection contact
5 second connection contact
6 separation region
7 chamber
8 further chamber
9 sabot
10 activatable material
11 predetermined breaking point
12 upsetting region
13 flange on the upsetting region for exposure to pressure by sabot
14 flange on the separation region
15 flange on the separation region
17 flange on the upsetting region
d diameter of a hole
L length of the extent of the separation region in the direction of the axis X
L2 length of the extent of the upsetting region in the direction of the axis X
R1-R5 radii of the cross-section transitions
s thickness of the region of the minimum wall thickness
t length of the cylindrical regions with minimum wall thickness in the upsetting region
w1-w4 angles of the linear increase in the wall thickness
X axis X
z length of the cylindrical region with minimum wall thickness in the separation region

The invention claimed is:

1. An electrical interruption switch for interrupting high currents at high voltages, the electrical interruption switch comprising:

a casing surrounding a contact unit defining a current path through the interruption switch, the contact unit having a first connection contact and a second connection contact and a separation region, the contact unit configured to receive a current supplied to the contact unit via the first connection contact and discharge the current therefrom via the second connection contact, or vice versa, the separation region comprising a tubular element, an axial direction of extent of which runs along an axis X, wherein the tubular element is separable into two parts along a plane perpendicular to the axis X, whereby the current is interrupted between the first connection contact and the second connection contact, the tubular element having two opposite end regions along a direction of extent of the axis X, the tubular element having a minimum wall thickness, which increases, in respective directions of the two opposite end regions, in a region between the two opposite end regions.

2. The electrical interruption switch according to claim 1, wherein the wall thickness increases conically in the respective directions of the two opposite end regions.

3. The electrical interruption switch according to claim 2, wherein an increase in the wall thickness runs mirror-symmetrically in the respective directions of the two opposite end regions, wherein a mirror plane is arranged in the region of the minimum wall thickness perpendicular to the axis X.

4. The electrical interruption switch according to claim 1, wherein at least one chamber in the interruption switch, which is at least partially delimited by the separation region, is filled with an extinguishing agent, such that the separation region is in contact with the extinguishing agent.

5. The electrical interruption switch according to claim 1, wherein the interruption switch has a sabot movable from a starting position into an end position, wherein in the end position of the sabot an insulation spacing between the first and the second connection contact is achieved.

6. The electrical interruption switch according to claim 5, wherein the contact unit has an upsetting region, which is formed such that the contact unit is upset during movement of the sabot from the starting position into the end position, wherein the upsetting region is designed as a tubular or rod-shaped element, the axial direction of extent of which runs along the axis X, wherein a cross-sectional diameter of the tubular or rod-shaped element has one or more tapers, wherein the cross-sectional diameter is in a plane perpendicular to the axis X.

7. The electrical interruption switch according to claim 1, wherein the interruption switch comprises an activatable material, which is arranged such that, when the activatable material is ignited, the separation region is exposed to a gas pressure or shock wave generated by the activatable material, such that the separation region is torn open, caved in or separated.

8. The electrical interruption switch according to claim 1, wherein the interruption switch has a sabot movable from a starting position into an end position, and the interruption switch comprises an activatable material, wherein the sabot is designed such that, when the activatable material is ignited, the sabot is exposed to a gas pressure or shock wave generated by the activatable material such that the sabot in the casing is moved in a movement direction from the starting position into the end position and the separation region is torn open, caved in or separated.

9. The electrical interruption switch according to claim 1, wherein the interruption switch has a sabot movable from a starting position into an end position, and at least one chamber in the interruption switch, which is at least partially delimited by the separation region, is filled with an extinguishing agent, such that the separation region is in contact with the extinguishing agent, wherein the separation region, the sabot and the extinguishing agent are formed such that the separation region is separable into at least two parts through the supplied current when a threshold amperage is exceeded, wherein an electric arc forming between the two parts of the separation region vaporizes the extinguishing agent, such that a gas pressure to which the sabot is exposed forms, wherein the sabot in the casing is moved in a movement direction from the starting position into the end position.

10. The electrical interruption switch according to claim 1, wherein the separation region has a predetermined breaking point comprising a hole through the wall of the tubular element.

* * * * *